US011133601B2

(12) United States Patent
Yoon et al.

(10) Patent No.: US 11,133,601 B2
(45) Date of Patent: Sep. 28, 2021

(54) FRACTAL-RECTANGULAR REACTIVE IMPEDANCE SURFACE FOR ANTENNA MINIATURIZATION

(71) Applicants: University of Florida Research Foundation, Inc., Gainesville, FL (US); Electronics and Telecommunications Research Institute (ETRI), Daejeon (KR)

(72) Inventors: Yong Kyu Yoon, Gainesville, FL (US); Seahee Hwangbo, Gainesville, FL (US); Hae Yong Yang, Daejeon (KR)

(73) Assignees: University of Florida Research Foundation, Incorporated, Gainesville, FL (US); Electronics and Telecommunications Research Institute (ETRI), Daejeon (KR)

( * ) Notice: Subject to any disclaimer, the term of this patent is extended or adjusted under 35 U.S.C. 154(b) by 352 days.

(21) Appl. No.: 16/092,019

(22) PCT Filed: Apr. 14, 2017

(86) PCT No.: PCT/US2017/027552
§ 371 (c)(1),
(2) Date: Oct. 8, 2018

(87) PCT Pub. No.: WO2017/180956
PCT Pub. Date: Oct. 19, 2017

(65) Prior Publication Data

US 2019/0115671 A1 Apr. 18, 2019

Related U.S. Application Data

(60) Provisional application No. 62/322,448, filed on Apr. 14, 2016.

(51) Int. Cl.
*H01Q 15/00* (2006.01)
*H01Q 13/10* (2006.01)
(Continued)

(52) U.S. Cl.
CPC ..... *H01Q 21/065* (2013.01); *H01Q 1/00* (2013.01); *H01Q 1/38* (2013.01); *H01Q 1/48* (2013.01);
(Continued)

(58) Field of Classification Search
CPC . H01Q 15/00–150093; H01Q 15/0013; H01Q 15/0093; H01Q 15/0006
See application file for complete search history.

(56) References Cited

U.S. PATENT DOCUMENTS 6,140,975 A 10/2000 Cohen
2002/0149519 A1 10/2002 Varadan et al.
(Continued)

FOREIGN PATENT DOCUMENTS

WO WO-2006098587 A1 * 9/2006 ..... H01Q 15/0013

OTHER PUBLICATIONS

Bao et al., A Novel GPS Patch Antenna on a Fractal Hi-Impedance Surface Substrate, IEEE Antennas and Wireless Propagation Letters, vol. 5, 2006 (Year: 2006).*
(Continued)

*Primary Examiner* — Dameon E Levi
*Assistant Examiner* — Jennifer F Hu
(74) *Attorney, Agent, or Firm* — Thomas | Horstemeyer, LLP

(57) ABSTRACT

Various examples are provided that are related to fractal-based reactive impedance surfaces. These surfaces allow for miniaturization of antennas. In one example, a fractal rectangular reactive impedance surface (FR-RIS) includes a plurality of fractal rectangular (FR) patches having an outer
(Continued)

edge defined by a fractal rectangular pattern that is repeated along each side of inner FR patches of the plurality of FR patches. The fractal rectangular pattern of a FR patch matches with the fractal rectangular pattern of an adjacent FR patch. An antenna can include a planar antenna disposed over the FR-RIS.

19 Claims, 16 Drawing Sheets

(51) Int. Cl.

| | |
|---|---|
| ***H01Q 21/06*** | (2006.01) |
| ***H01Q 1/48*** | (2006.01) |
| ***H01Q 9/16*** | (2006.01) |
| ***H01Q 1/38*** | (2006.01) |
| ***H01Q 9/04*** | (2006.01) |
| ***H01Q 11/10*** | (2006.01) |
| ***H01Q 1/00*** | (2006.01) |
| ***H01Q 3/04*** | (2006.01) |
| ***H01Q 21/00*** | (2006.01) |

(52) U.S. Cl.
CPC ..... *H01Q 3/04* (2013.01); *H01Q 9/04* (2013.01); *H01Q 9/045* (2013.01); *H01Q 9/0407* (2013.01); *H01Q 9/0428* (2013.01); *H01Q 9/0442* (2013.01); *H01Q 9/16* (2013.01); *H01Q 11/10* (2013.01); *H01Q 13/10* (2013.01); *H01Q 15/0093* (2013.01); *H01Q 21/0025* (2013.01)

(56) References Cited

U.S. PATENT DOCUMENTS

| | | | | |
|---|---|---|---|---|
| 2003/0011522 | A1* | 1/2003 | McKinzie, III ..... | H01Q 15/008 343/700 MS |
| 2008/0180341 | A1 | 7/2008 | Cohen | |
| 2010/0265159 | A1* | 10/2010 | Ando ..... | H01Q 15/008 343/913 |
| 2011/0273319 | A1 | 11/2011 | Mossallael | |
| 2013/0131752 | A1 | 5/2013 | Rawat et al. | |
| 2014/0097995 | A1* | 4/2014 | McKinzie, III ..... | H01Q 9/045 343/793 |

OTHER PUBLICATIONS

International Search Report for PCT/US2017/027552 dated Jun. 26, 2017.

"Compact Circularly-Polarized Patch Antenna Loaded With Metamaterial Structures" by Dong et al. (IEEE Trans. on Antennas and Propagation, vol. 59, No. 11, Nov. 2011).

"Wideband Circularly Polarized Patch Antennas on Reactive Impedance Substrates" by Bernard et al. (IEEE Antennas and Wireless Propagation Letters, vol. 10, Sep. 2011).

"Miniaturized Patch Antennas loaded with Complementary Split-Ring Resonators and Reactive Impedance Surface" by Dong et al. (European Conf. on Antennas and Propagation (EUCAP), Apr. 2011).

"RIS-Based Compact Circularly Polarized Microstrip Antennas" by Agarwal et al. (IEEE Trans. on Antennas and Propagation, vol. 61, No. 2, Feb. 2013).

"Antenna Miniaturization and Bandwidth Enhancement Using a Reactive Impedance Substrate" by Mosallaei et al. (IEEE Trans. on Antennas and Propagation, vol. 52, No. 9, Sep. 2004).

* cited by examiner

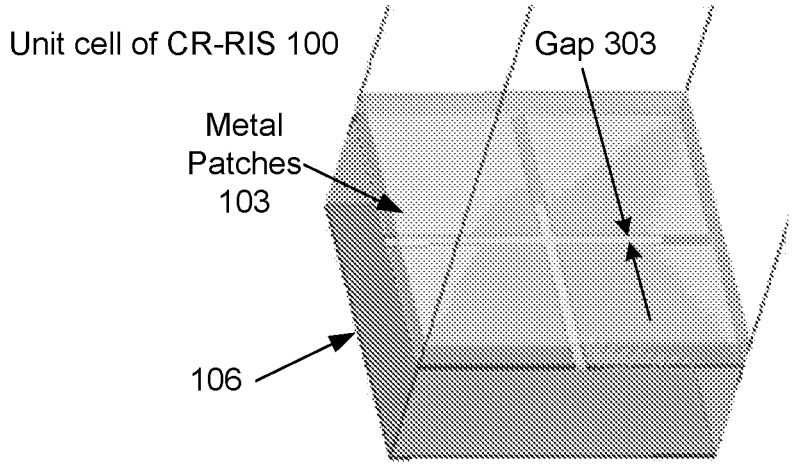
FIG. 3A
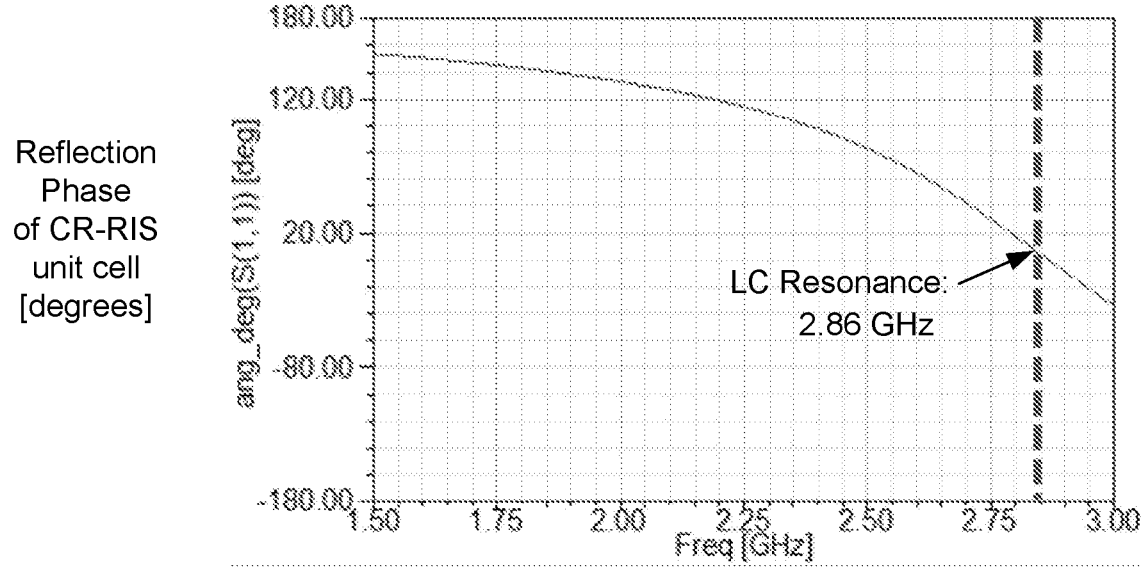
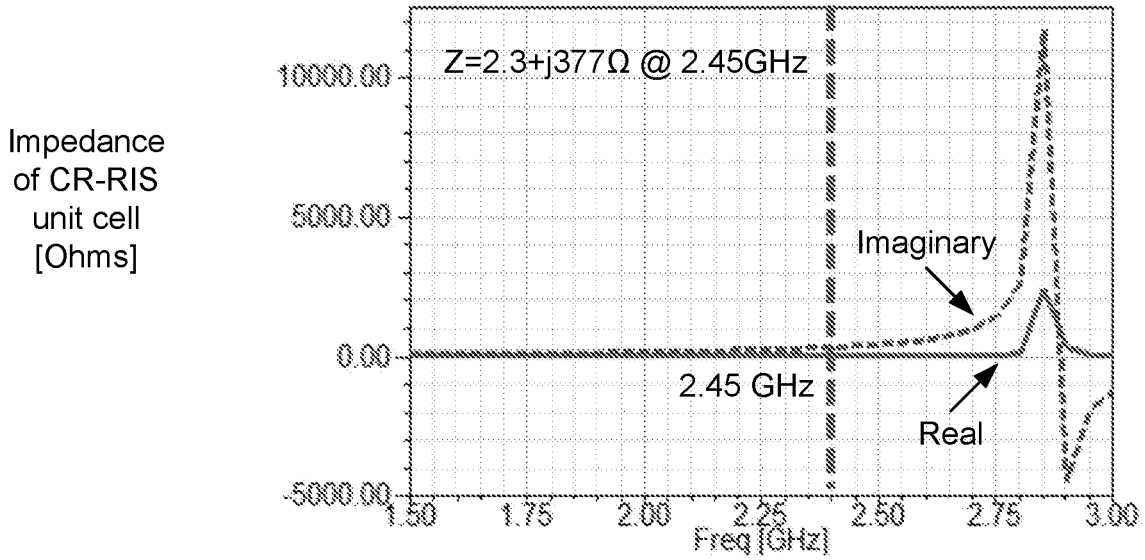

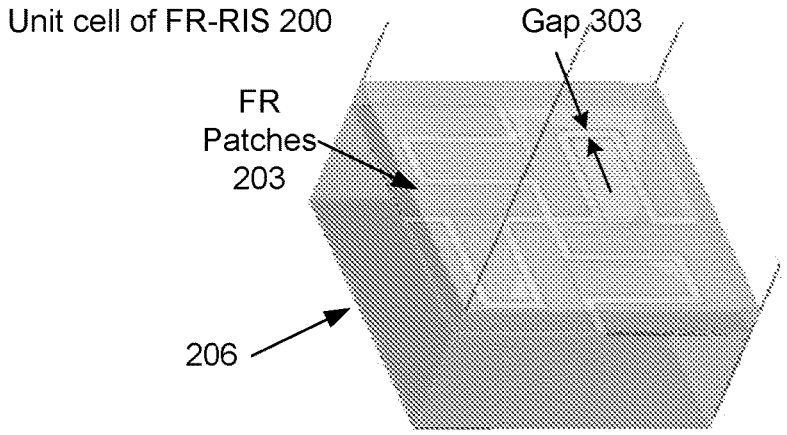
FIG. 3B
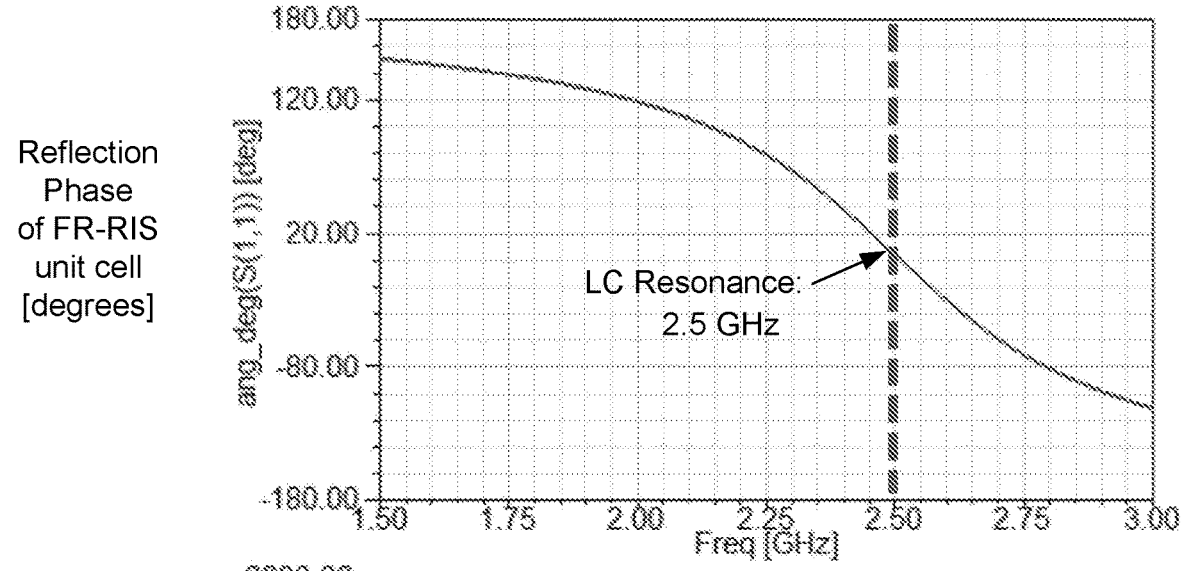
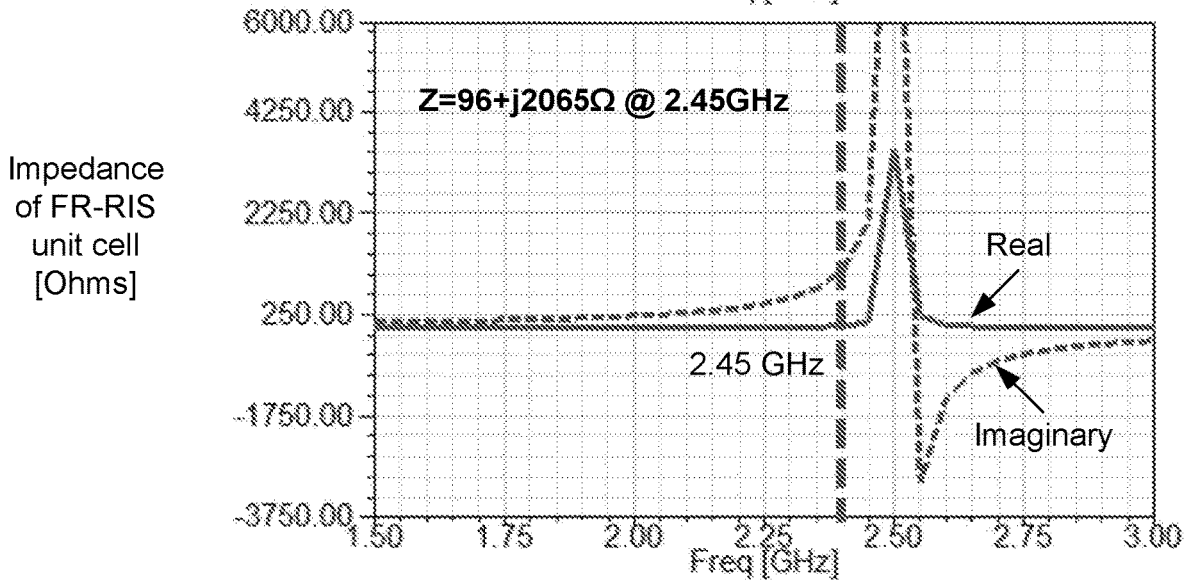

| Parameters | Simulation |
|---|---|
| Center Frequency | 2.45 GHz |
| Return Loss | 27dB |
| 10 dB Bandwidth | 172MHz (2.36GHz – 2.53GHz) |
| Axial Ratio | 1 dB |
| 3 dB Axial Ratio Bandwidth | 46MHz (2.42GHz – 2.47GHz) |
| Polarization | RHCP |
| Radiation Pattern | Broadside |
| Gain | 4.8dBic |

| Antenna figure | RIS structure | Resonant Freq. | Designed Patch Size | Substrate Size | 10 dB Bandwidth | 3 dB Axial Ratio Bandwidth | Gain |
|---|---|---|---|---|---|---|---|
| [1] Mushroom structure 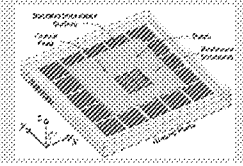 | Conventional Rectangular RIS | 2.58GHz | 20.6mm x 20.6mm ($0.355\lambda_g$ x $0.355\lambda_g$) | 36mm x 36mm | - | 1.6% | 2.98 dBic |
| [2] 45 degrees rotated slot 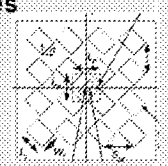 | 45 degrees-rotated Conventional Rectangular RIS | 2.3GHz | 19mm x 19mm ($0.38\lambda_g$ x $0.38\lambda_g$) $=0.144\lambda_g^2$ | 100mm x 100mm | 320MHz (14%) | - | 0 dBic |
| [3] Two CSRR on patch 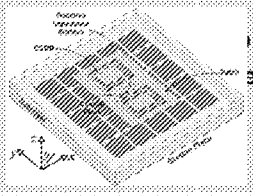 | nventional ectangular RIS | 2.8GHz | 20.6mm x 20.6mm ($0.355\lambda_g$ x $0.355\lambda_g$) $=0.126\lambda_g^2$ | 36mm x 36mm | - | - | 4 dBic |
| [4] Cross-slots on patch 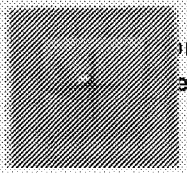 | nventional ectangular RIS | 2.5GHz | 20.6mm x 20.6mm ($0.355\lambda_g$ x $0.355\lambda_g$) | 36mm x 36mm | 3.84% | - | 3.2 dBic |
| **Rotated Slot Antenna of FIG. 2A** 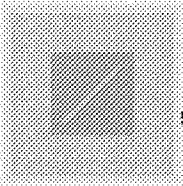 | **Fractal ectangular RIS** | **2.45GHz (Wi-Fi)** | **16.5mm x 16.5mm ($0.317\lambda_g$ x $0.317\lambda_g$) $=0.1\lambda_g^2$ (20%reduction)** | **36mm x 36mm** | **172MHz (6.9%)** | **46MHz (1.8%)** | **4.85 dBic** |

FIG. 4E

| Parameters | Simulation |
|---|---|
| Center Frequency | 1.575 GHz |
| Return Loss | 26dB |
| 10 dB Bandwidth | 30MHz (19%) |
| Axial Ratio | 0.6 dB |
| 3 dB Axial Ratio Bandwidth | 9MHz (0.6%) |
| Polarization | RHCP |
| Radiation Pattern | Broadside |
| Gain | 0.025dBic |

DUT

Horn Antenna for Measurement

| Parameters | Simulation | Measurement |
|---|---|---|
| Resonant Frequency | 1.575 GHz | 1.575 GHz |
| Return Loss | 24.8 dB | 42.2 dB |
| 10dB Bandwidth | 30 MHz | 28 MHz |
| Axial Ratio | 0.5321 dB | 2.34 dB |
| 3dB Axial Ratio | 9 MHz | 2.5 MHz |
| Gain | 0.045 dB | -1 dB |

FIG. 8D

FRACTAL-RECTANGULAR REACTIVE IMPEDANCE SURFACE FOR ANTENNA MINIATURIZATION

CROSS REFERENCE TO RELATED APPLICATIONS

This application claims priority to, and the benefit, of U.S. provisional application entitled "Fractal-Rectangular Reactive Impedance Surface for Antenna Miniturization" having Ser. No. 62/322,448, filed Apr. 14, 2016, which is hereby incorporated by reference in its entirety.

STATEMENT REGARDING FEDERALLY SPONSORED RESEARCH OR DEVELOPMENT

This invention was made with government support under agreement 120957 awarded by the Multi-Functional Integrated System Technology (MIST) Center of the National Science Foundation (NSF). The Government has certain rights to the invention.

BACKGROUND

Planar antennas, because of their ease of fabrication and integration as well as compactness and low-profile characteristics, are highly desirable for wireless communication systems. The substrates of planar antennas play a very important role in achieving desirable electrical and physical characteristics. Design of antenna elements with significant front-to-back radiation ratio is either accomplished through the use of metal-backed substrates or high dielectric superstrates. Use of a reactive impedance surface (RIS) as a substrate for planar antennas can enhance the bandwidth and radiation characteristics of the antenna.

SUMMARY

Aspects of the present disclosure are related to fractal-based reactive impedance surfaces for use with antennas.

In one aspect, among others, a fractal rectangular reactive impedance surface (FR-RIS) comprises a plurality of fractal rectangular (FR) patches having an outer edge defined by a fractal rectangular pattern that is repeated along each side of inner FR patches of the plurality of FR patches, where the fractal rectangular pattern of one of the plurality of FR patches matches with the fractal rectangular pattern of an adjacent FR patch of the plurality of FR patches. In one or more aspects, an antenna can comprise a planar antenna disposed over the FR-RIS. The fractal rectangular pattern can comprise a rectangular tab extending outward from each side of the inner FR patches and a corresponding rectangular recess extending inward from each side of the inner FR patches. The FR-RIS can comprise a gap defined by the fractal rectangular pattern of adjacent FR patches of the plurality of FR patches, wherein the gap distance between the adjacent FR patches substantially constant. A capacitance of the FR-RIS can be based at least in part upon a length of the outer edge of the plurality of FR patches.

In one or more aspects, the FR-RIS can comprise a substrate disposed between the planar antenna and the plurality of FR patches. The planar antenna can be coupled to a feeding line that passes through the plurality of FR patches and the substrate. The feeding line can be a coaxial feeding line. The plurality of FR patches can be disposed on a first side of a substrate, and the FR-RIS comprises a ground plane disposed on a second side of the substrate opposite the plurality of FR patches. An inductance of the FR-RIS can be based at least in part upon a distance between the ground plane and the plurality of FR patches. The inductance of the FR-RIS can be further based upon a shape of the FR patches.

In one or more aspects, the planar antenna is a patch antenna. The patch antenna can comprise a slot. The slot can be rotated with respect to the patch antenna. The slot can be rotated at an angle of 45 degrees with respect to edges of the plurality of FR patches. In one or more aspects, an outer edge of the FR-RIS defines a rectangular shape. The rectangular shape can be a square. Outer FR patches of the plurality of FR patches can be distributed along the outer edge of the FR-RIS, the outer FR patches trimmed to provide the rectangular shape. In one or more aspects, the patch antenna disposed over the FR-RIS can have a rectangular shape that is substantially aligned with the rectangular shape of the FR-RIS. The patch antenna can be smaller than the FR-RIS. The fractal rectangular pattern of adjacent FR patches of the plurality of FR patches are interdigitated.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims. In addition, all optional and preferred features and modifications of the described embodiments are usable in all aspects of the disclosure taught herein. Furthermore, the individual features of the dependent claims, as well as all optional and preferred features and modifications of the described embodiments are combinable and interchangeable with one another.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

FIGS. 3A and 3B illustrate characteristics of a unit cell of CR-RIS and a unit cell of FR-RIS, respectively, in accordance with various embodiments of the present disclosure.

FIGS. 4A through 4E illustrate simulated characteristics of a patch antenna on a FR-RIS, in accordance with various embodiments of the present disclosure.

FIGS. 8A through 8D compare measured and simulated characteristics of the GPS antenna of FIG. 5, in accordance with various embodiments of the present disclosure.

DETAILED DESCRIPTION

Figure 1:
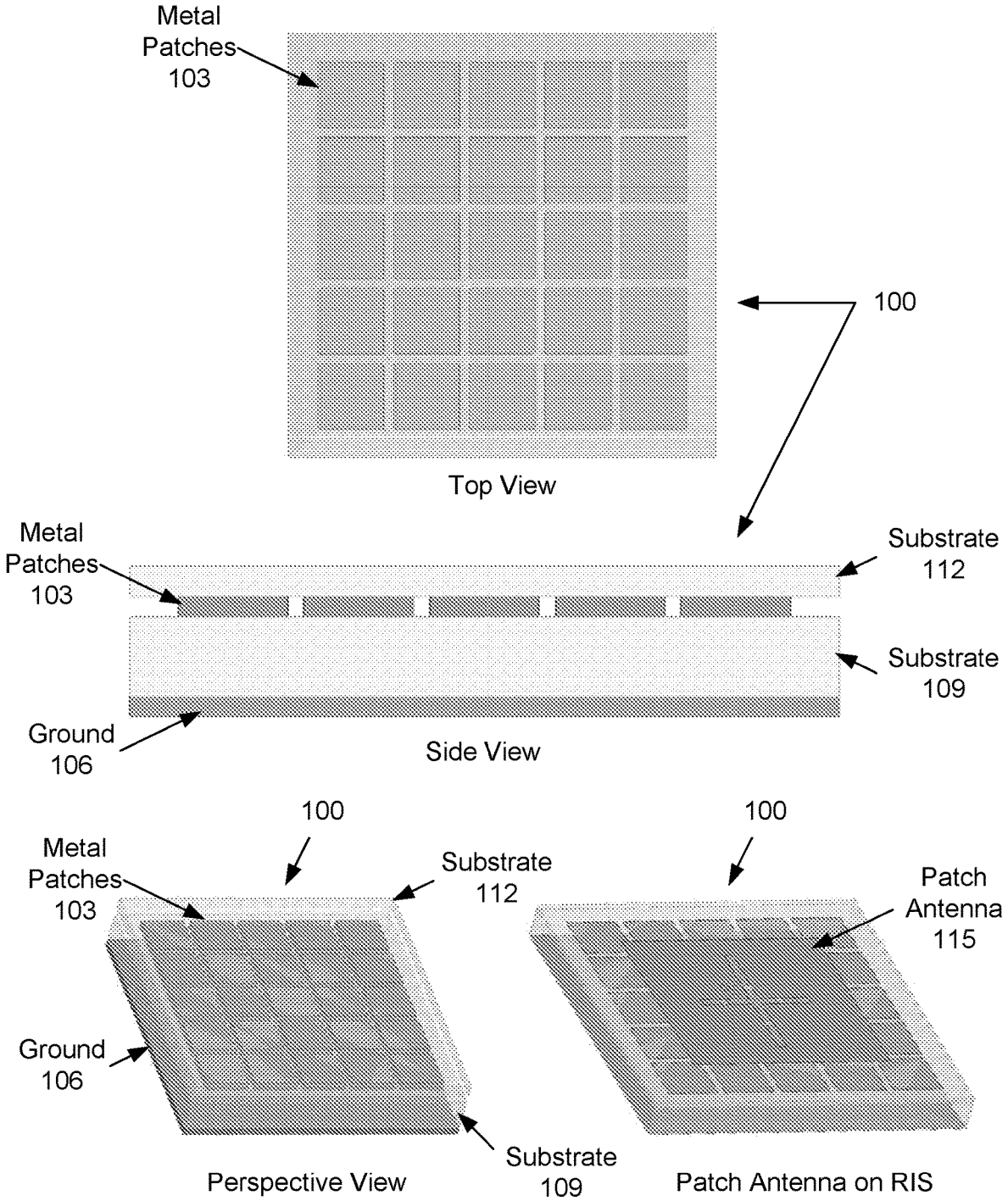
FIG. 1 illustrate an example of a conventional rectangular reactive impedance surface (CR-RIS) in accordance with various embodiments of the present disclosure.

Disclosed herein are various embodiments of methods related to fractal-based reactive impedance surfaces for use with antennas. Reference will now be made in detail to the description of the embodiments as illustrated in the drawings, wherein like reference numbers indicate like parts throughout the several views.

Referring to FIG. 1, shown are top, side and perspective views of a conventional rectangular reactive impedance surface (CR-RIS) 100 that includes a periodic pattern of square metallic patches 103 printed on a planar grounded substrate without any via. As shown in the side view, a ground plane 106 is disposed on one side of a first substrate 109. In the example of FIG. 1, a 5×5 pattern of patches 103 are disposed on the first substrate 109 opposite the ground 106. A second substrate 112 can be disposed over the patches 103.

The CR-RIS 100 has a purely reactive impedance (either inductive or capacitive). The gap between adjacent rectangular patches 103 produces capacitance and a ground plane 106 located at the bottom of the two substrates produces inductance of the CR-RIS 100, which determines the resonant frequency of the CR-RIS 100. In order to increase/decrease the resonant frequency and the surface impedance of the CR-RIS 100, the total length of the capacitive gap between the patches 103 should be changed by increasing/decreasing the size of rectangular patch 103. The bigger size of the CR-RIS 100 is necessarily required for the lower resonant frequency of CR-RIS 100, which is undesirable for compact antenna applications.

Antenna miniaturization can be achieved by combining the inductive and/or capacitive behavior of the CR-RIS 100 with the capacitive and/or inductive behavior of the patch radiator 115 at relatively low frequencies, which can be lower than the resonant frequency. FIG. 1 illustrates an example of a patch antenna or radiator 115 on a CR-RIS 100. Additional discussion about the CR-RIS 100 is provided in "Antenna Miniaturization and Bandwidth Enhancement Using a Reactive Impedance Substrate" by Mosallaei et al. (*IEEE Trans. on Antennas and Propagation*, Vol. 52, No. 9, September 2004), which is hereby incorporated by reference in its entirety.

A fractal rectangular RIS (FR-RIS) can be utilized to reduce the antenna size and achieve compact high-gain antennas for high-efficiency wireless communication systems. The use of a FR-RIS allows the antenna size to be reduced by providing additional compensation for the capacitive impedance of the antenna. A wide variety of antennas can be integrated on top of the FR-RIS to achieve further antenna miniaturization, while maintaining the high gain and antenna efficiency. By scaling the fractal rectangular structure, the resonant frequency and surface impedance of the FR-RIS can be controlled.

Figure 2A:
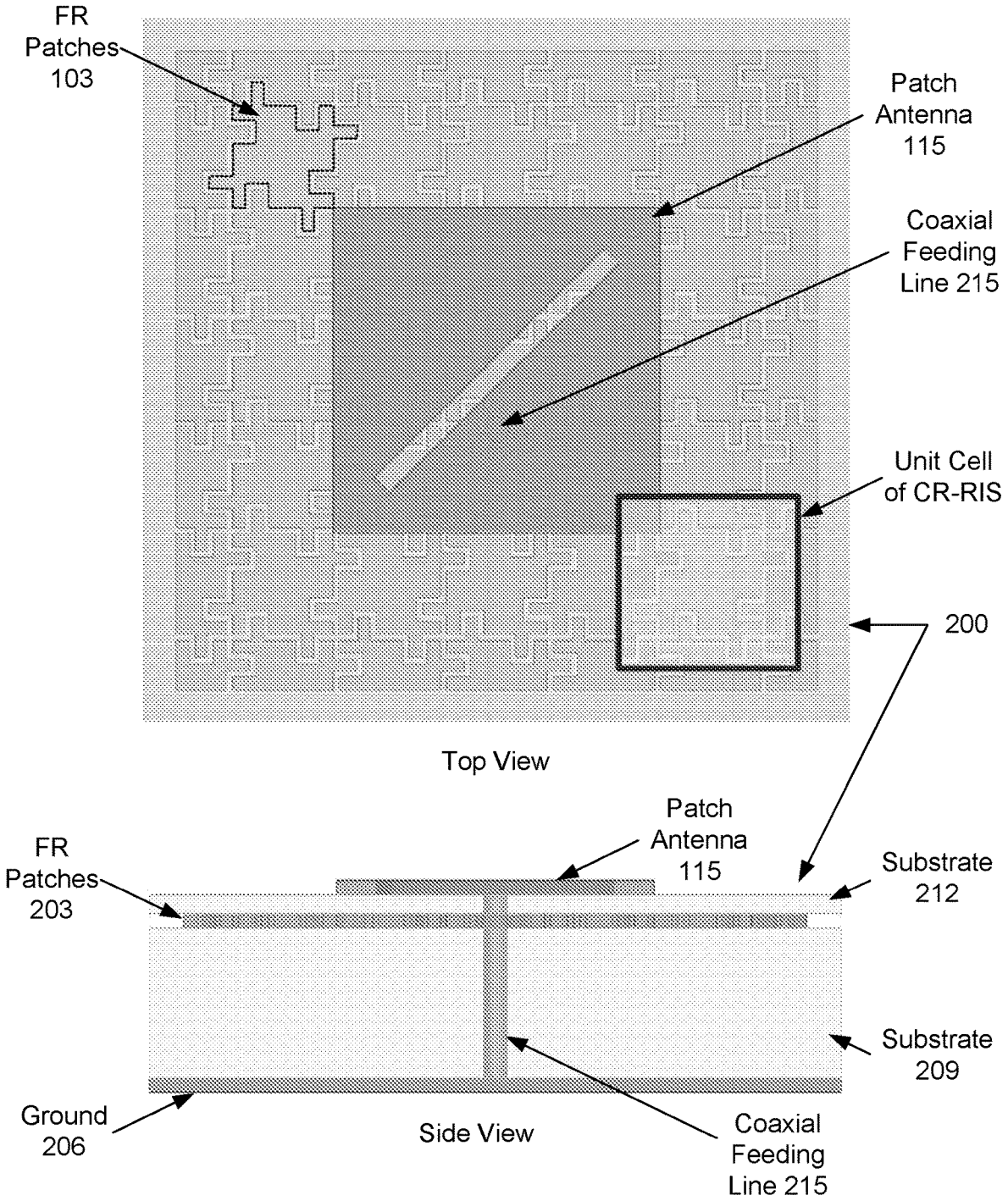
FIGS. 2A and 2B illustrate examples of fractal rectangular reactive impedance surfaces (FR-RIS) in accordance with various embodiments of the present disclosure.
Figure 2B:
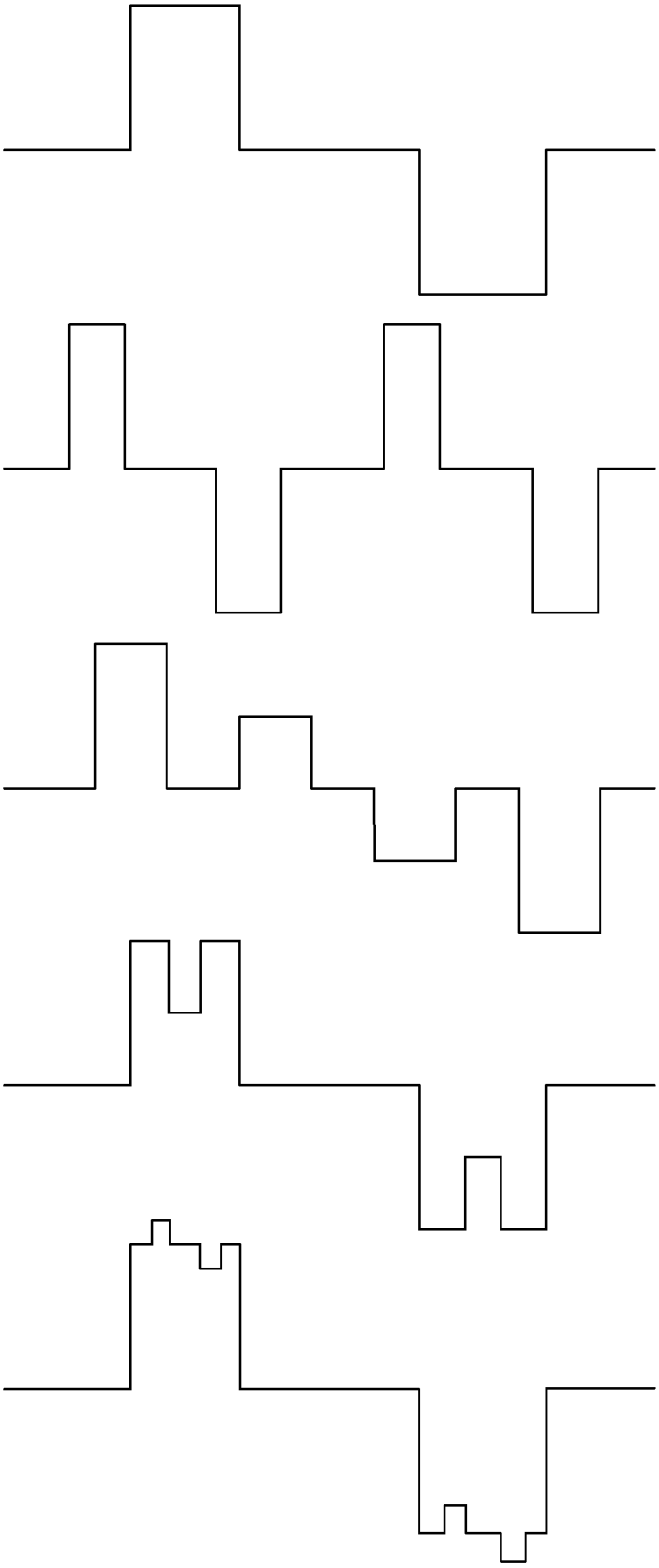

Referring now to FIG. 2A, shown are top and side views of an example of an antenna on a fractal rectangular RIS (FR-RIS) 200 that includes a N×N periodic pattern of metallic patches 203 with fractal rectangular edges (or FR patches 203). The FR patches 203 include a fractal rectangular shape, one of which is highlighted by the dashed line in FIG. 2A, which can be scaled to adjust the total length of the capacitive gap between adjacent patches 203. By changing the length (or depth) and/or width of elements of the fractal pattern, the total length of the patches 203 can be increased or decreased without changing the total area of the patches 203. In addition, the length may be adjusted by changing the number of elements or steps of the fractal rectangular pattern. In the example of FIG. 2A, each side of the FR patch 203 includes a tab and corresponding recess. In other embodiments, each side of the FR patch 203 can include a plurality of tabs and corresponding recesses, which may be grouped or interspersed along the side. In some embodiments, the fractal rectangular pattern can be repeated on the tab and in the recess. FIG. 2B shows examples of fractal rectangular patterns that can be implemented along the adjacent sides of the FR patches 203. As shown in FIG. 2A, the FR patches 203 along the outer edge of the FR-RIS 200 can be trimmed to provide a smooth rectangular shape for the FR-RIS 200.

As seen in the side view of FIG. 2A, the FR patches 203 are located between a first substrate 209 and a second substrate 212. In the example of FIG. 2A, a patch antenna 115 is on the side of the second substrate 212 opposite the FR patches 203. The first substrate 209 includes a metal ground plane 206 on the side opposite the FR patches 203. The gap between adjacent FR patches 203 and the gap between the pattern of FR patches 203 and the ground plane 206 produce capacitance (C). The length of each patch and the ground plane produces inductance (L). The FR-RIS 200 can be represented as a parallel LC tank circuit whose resonant frequency is inversely proportional to the square root of the product of the capacitance and inductance of FR-RIS 200. The FR-RIS 200 behaves as an inductive surface (or inductive impedance) below the resonant frequency and compensates for the capacitive impedance of the antennas, thereby realizing impedance matching and resulting in the antenna miniaturization. A size reduction of at least 20% (or more) can be achieved using a FR-RIS 200 instead of a CR-RIS 100 because of the higher inductive impedance produced by the fractal rectangular structure of the FR-RIS 200.

Referring next to FIGS. 3A and 3B, shown are characteristics of examples of a unit cell of a CR-RIS 100 of FIG. 1 and a unit cell of a FR-RIS 200 of FIG. 2A, respectively. Each unit cell being evaluated has an area of 5.4 mm×5.4 mm. In the example of FIG. 3A, the capacitance of the CR-RIS 100 can be controlled or adjusted by the distance of the gap 303 between the patches 103 and the inductance can be controlled or adjusted by the distance between the patches 103 and the ground plane (or perfect electrical conductor (PEC) surface) 106, and the shape of the patches. The distance between the patches 103 and the ground plane 106 can be defined by the thickness of the first substrate 109. As shown in FIG. 3A, the LC resonance occurs at 2.86 GHz. At a frequency of 2.45 GHz, the impedance of the unit cell of the CR-RIS 100 is 2.3+j377 Ohms.

A higher capacitance can be obtained in the same area by increasing the total length of the gap between adjacent FR-RIS patches 203. The fractal rectangular pattern can be adjusted to obtain a desired capacitance. In the example of FIG. 3B, the capacitance of the FR-RIS 200 can be controlled or adjusted by the distance of the gap 303 between the patches 203 and the inductance can be controlled or adjusted by the shape of the patches and by the distance between the patches 203 and the ground plane 206, which can be defined by the thickness of the first substrate 209. In the design of FIG. 2A, the LC resonance occurs at 2.5 GHz and the impedance of the unit cell of the FR-RIS 200, at the frequency of 2.45 GHz, is 96+j2065 Ohms.

Figure 4A:
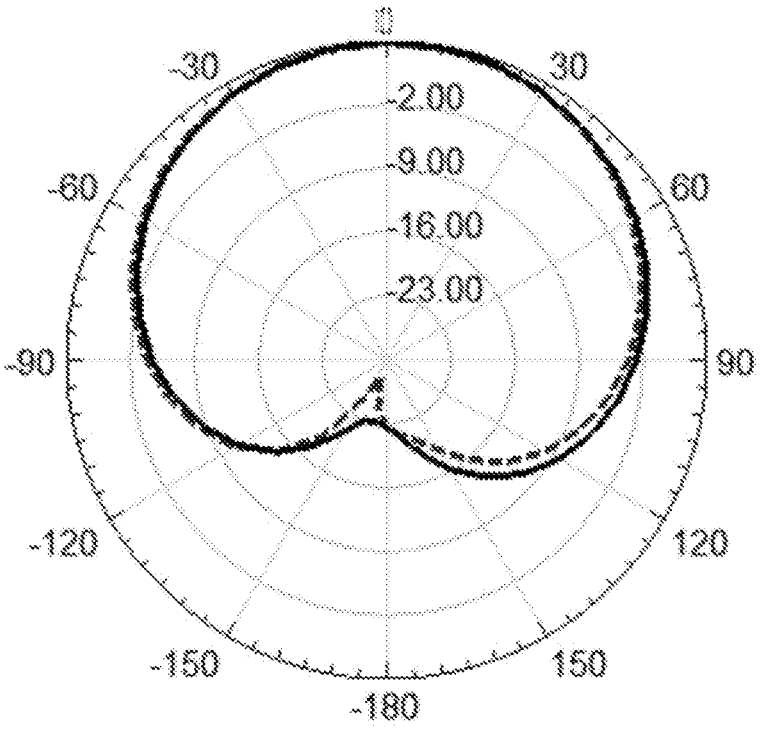
Figure 4B:
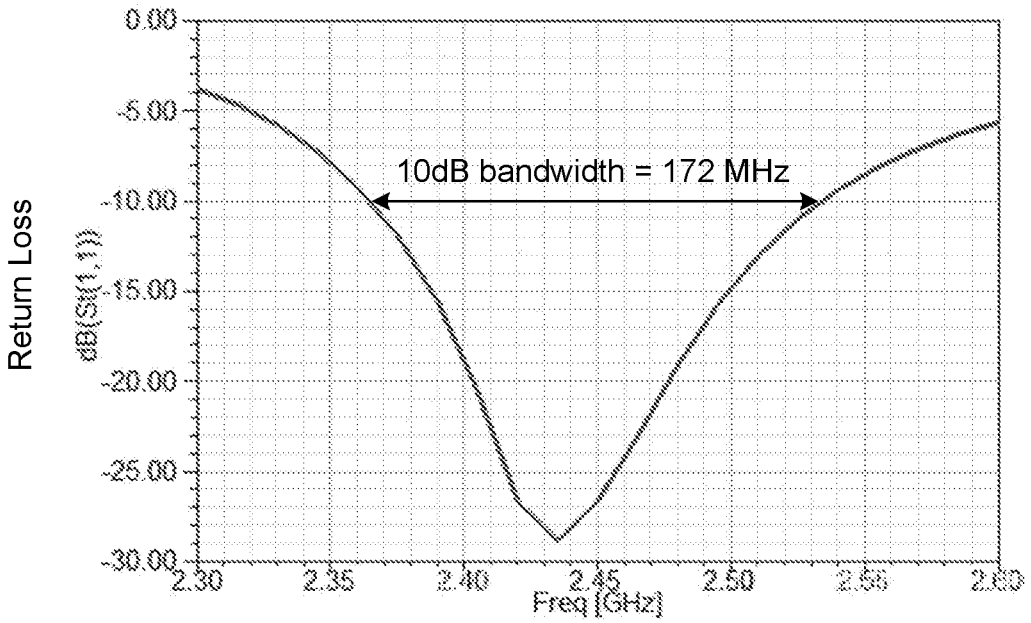
Figures 4C, 4D:
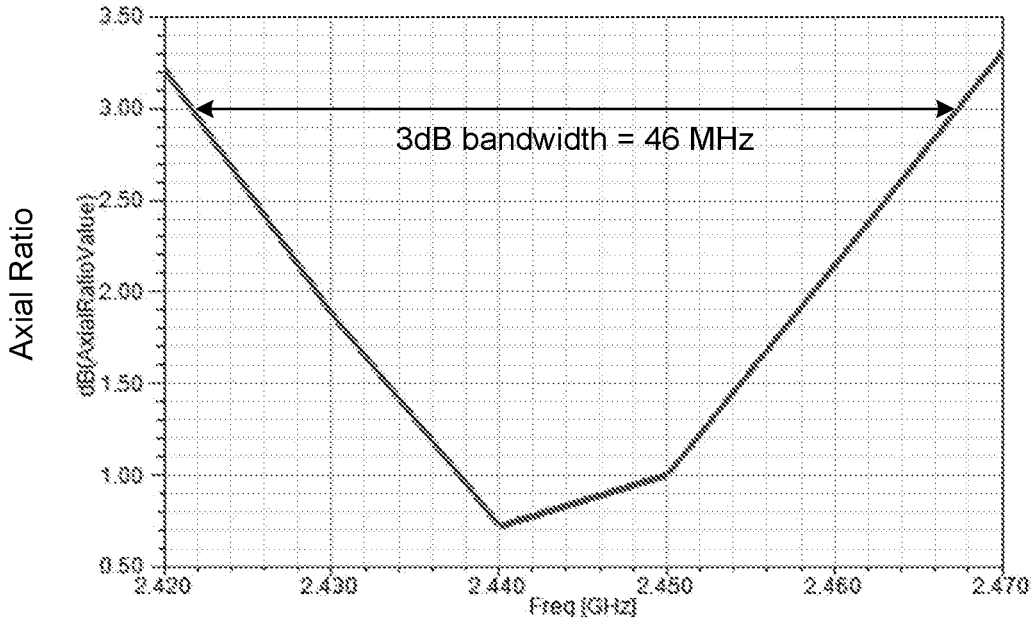

The design of the 2.45 GHz antenna on a FR-RIS 200 of FIG. 2A with a patch antenna 115 with a slot rotated at 45 degrees was evaluated. The first substrate 209 between the FR patches 203 and the ground plane 209 comprised a thermoset microwave material (e.g., Rogers TMM® 6) with a thickness of 5.08 mm, $\varepsilon_r$=6.2, and tan δ=0.002 and the second substrate 212 between the FR patches 203 and the patch antenna 115 comprised a thermoset microwave material (e.g., Rogers TMM® 3) with a thickness of 0.645 mm, $\varepsilon_r$=3.45, and tan δ=0.002. The patch antenna 115 with the rotated slot was provided on the second substrate 212 to produce right-hand circular polarization (RHCP) gain. A coaxial feeding line 215 was passed through the ground plane 206, first substrate 209, FR patches 203, and second substrate 212 to provide a connection to the patch antenna 115. FIG. 4A is a plot of the simulated radiation pattern produced by the 2.45 GHz antenna on the FR-RIS 200 of FIG. 2A. As can be seen, the RHCP gain shows a broadside radiation pattern. FIG. 4B is a plot of the return loss and FIG. 4C is a plot of the axial ratio for the 2.45 GHz antenna design. The simulation results are summarized in the table of FIG. 4D. The 2.45 GHz rotated slot antenna on the FR-RIS 200 of FIG. 2A provides a 10 dB bandwidth of 172 MHz and a 3 dB axial ratio bandwidth of 46 MHz.

When compared to previous antenna designs on CR-RIS 100, the use of the FR-RIS offers improved characteristics with reduced antenna sizes. Referring to FIG. 4E, shown is a table comparing characteristics of (1) a mushroom structure as described in "Compact Circularly-Polarized Patch Antenna Loaded With Metamaterial Structures" by Dong et al. (*IEEE Trans. on Antennas and Propagation*, Vol. 59, No. 11, November 2011); (2) a 45 degree rotated slot as described in "Wideband Circularly Polarized Patch Antennas on Reactive Impedance Substrates" by Bernard et al. (*IEEE Antennas and Wireless Propagation Letters*, Vol. 10, September 2011); (3) a complementary split-ring resonator (CSRR) on a patch as described in "Miniaturized Patch Antennas loaded with Complementary Split-Ring Resonators and Reactive Impedance Surface" by Dong et al. (*European Conf. on Antennas and Propagation* (*EUCAP*), April 2011); and (4) crossed slots on a patch as described in "RIS-Based Compact Circularly Polarized Microstrip Antennas" by Agarwal et al. (*IEEE Trans. on Antennas and Propagation*, Vol. 61, No. 2, February 2013). These four publications are hereby incorporated by reference in their entirety. As shown in FIG. 4E, use of the FR-RIS 200 allows for a 20% reduction in the size of the patch antenna 115 while providing an improved gain of 4.85 dBic.

Figure 5:
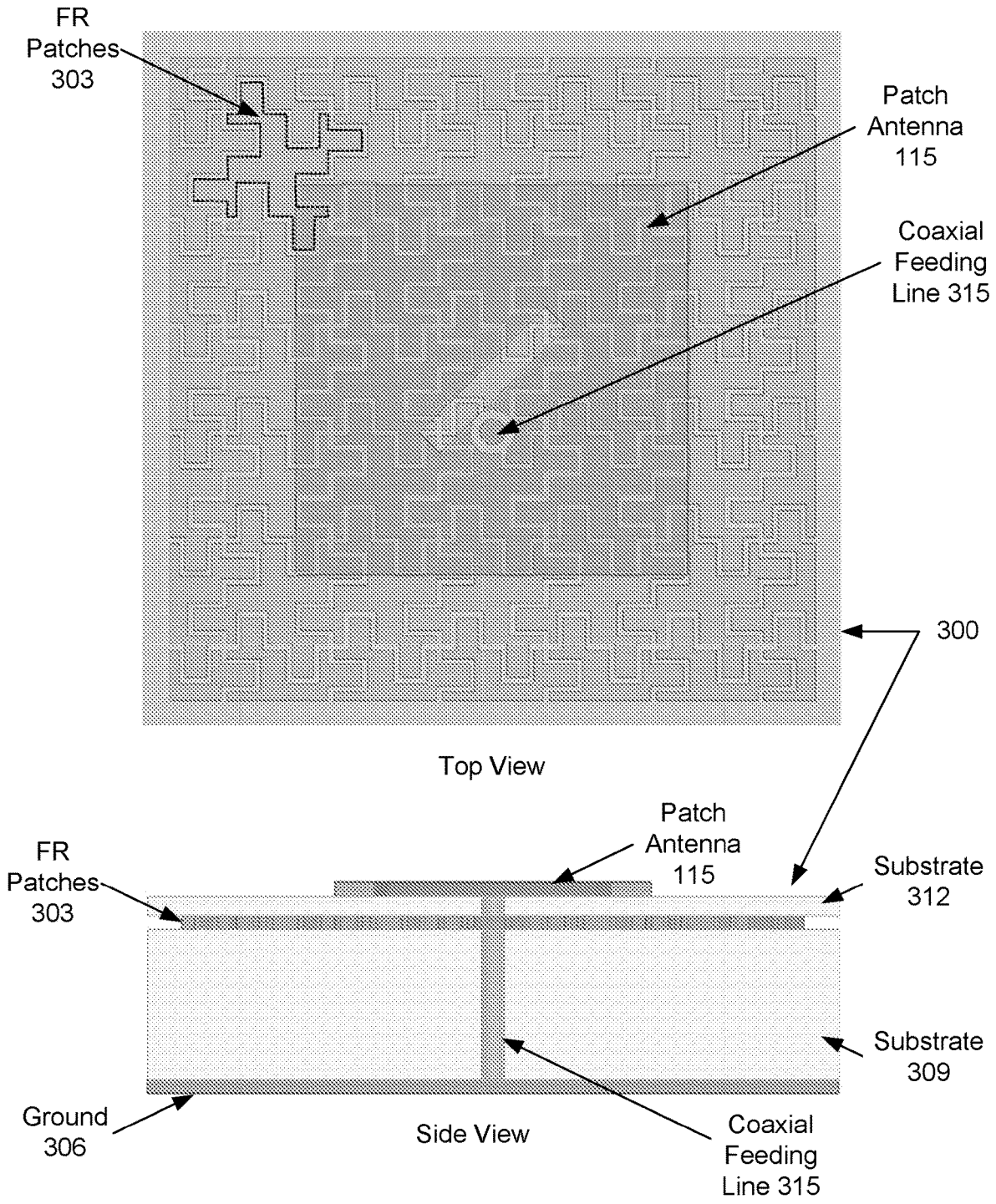
FIG. 5 is an example of a GPS patch antenna on a FR-RIS, in accordance with various embodiments of the present disclosure.

A global positioning system (GPS) antenna on a FR-RIS was designed, evaluated, implemented and tested. FIG. 5 shows top and side views of the GPS antenna including a fractal rectangular RIS (FR-RIS) 300 that includes an N×N periodic pattern of FR patches 303. The FR patches 303 include a fractal rectangular shape, one of which is highlighted by the dashed line in FIG. 5, which can be scaled to adjust the total length of the capacitive gap between adjacent patches 303 as previously discussed. As can be seen, while the general shape of the FR patches 303 of FIG. 5 is similar to the FR patches 203 of FIG. 2A, the dimensions have been changed to accommodate the needs of the GPS design.

As seen in the side view of FIG. 5, the FR patches 303 are located between a first substrate 309 and a second substrate 312. A patch antenna 115 including a slot rotated at 45 degrees is located on the side of the second substrate 312 opposite the FR patches 303. The rotated slot provides RHCP gain. The dimensions of the slot are different than those in FIG. 2A to account for the needs of the GPS design. A metal ground plane 306 is located on the side of the first substrate 309 that is opposite the FR patches 303. A coaxial feeding line 315 passes through the ground plane 306, first substrate 309, FR patches 303, and second substrate 312 to provide a connection to the patch antenna 115. The GPS antenna was implemented with the first substrate 309 between the FR patches 303 and the ground plane 309 comprising a thermoset microwave material (e.g., Rogers TMM® 10i) with a thickness of 5.08 mm, $\varepsilon_r$=9.8, and tan δ=0.002 and the second substrate 312 between the FR patches 303 and the patch antenna 115 comprising a filled PTFE (random glass or ceramic) composite laminate (e.g., Rogers RT/Duroid® 6010LM) with a thickness of 0.645 mm, $\varepsilon_r$=10.2, and tan δ=0.0023.

Figure 6A:
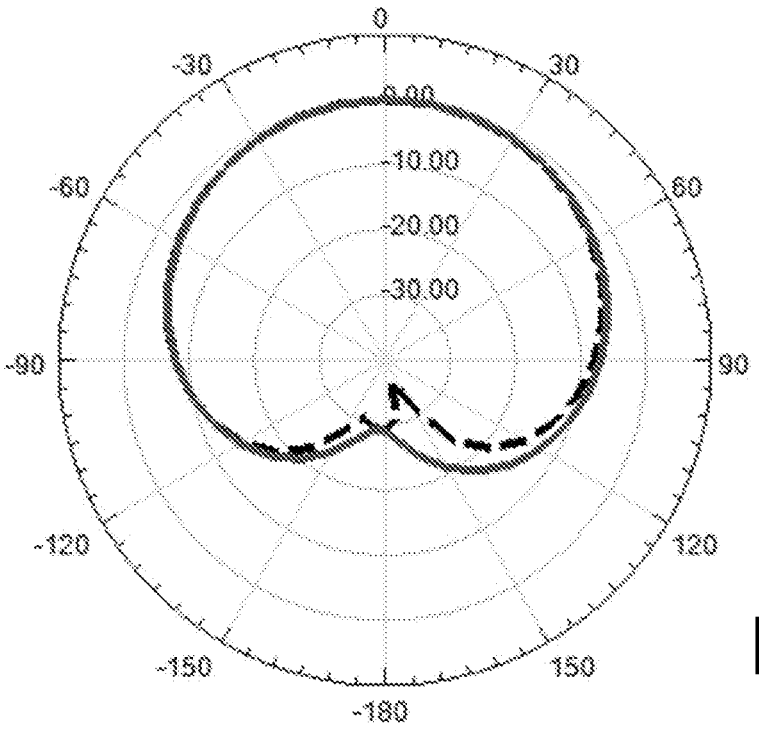
FIGS. 6A through 6D illustrate simulated characteristics of the GPS antenna of FIG. 5, in accordance with various embodiments of the present disclosure.
Figure 6B:
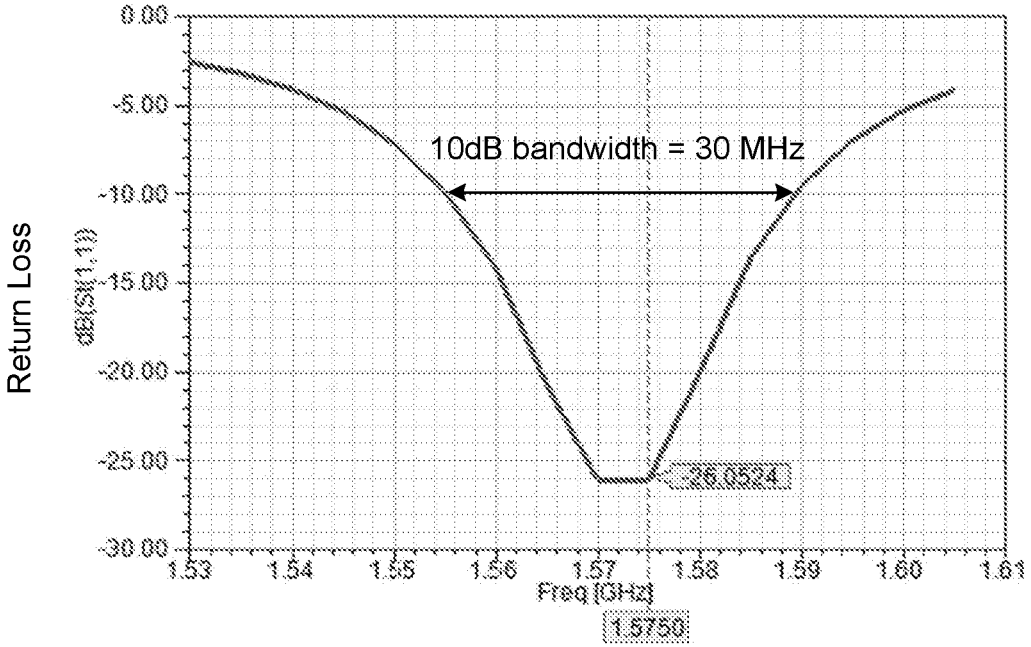
Figures 6C, 6D:
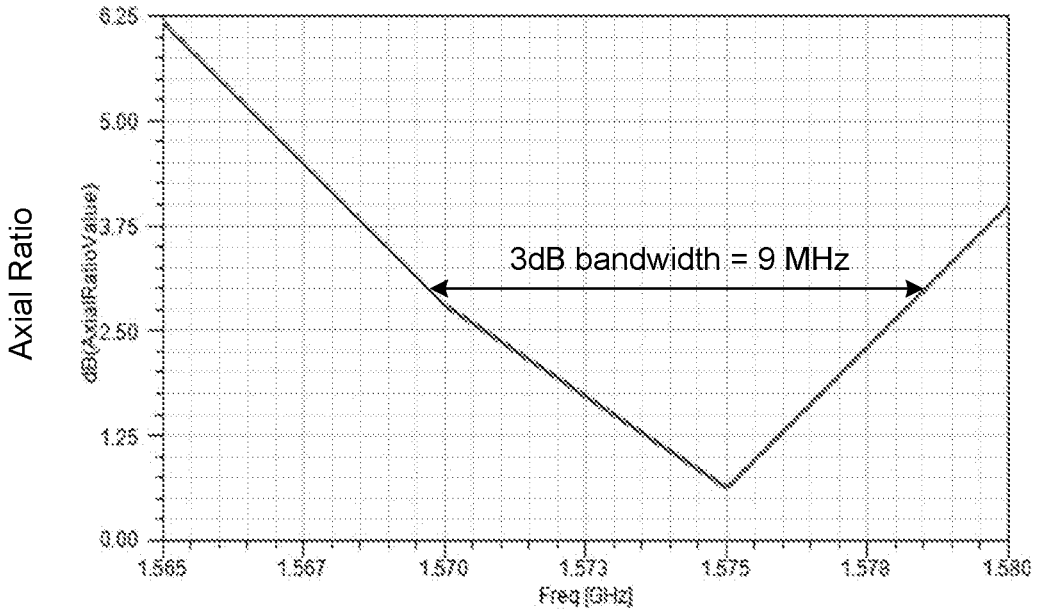

Referring to FIG. 6A, shown is a plot of the simulated radiation pattern produced by the 1.575 GHz antenna on the FR-RIS 300 of FIG. 5. As can be seen, the RHCP gain shows a broadside radiation pattern. The electric field vector of the RHCP rotates in a clock wise direction as the wave advances in the direction of propagation. FIG. 6B is a plot of the return loss and FIG. 6C is a plot of the axial ratio for the GPS antenna design. The simulation results are summarized in the table of FIG. 6D. The GPS rotated slot antenna on the FR-RIS 300 provides a 10 dB bandwidth of 30 MHz and a 3 dB axial ratio bandwidth of 9 MHz.

Figure 7A:
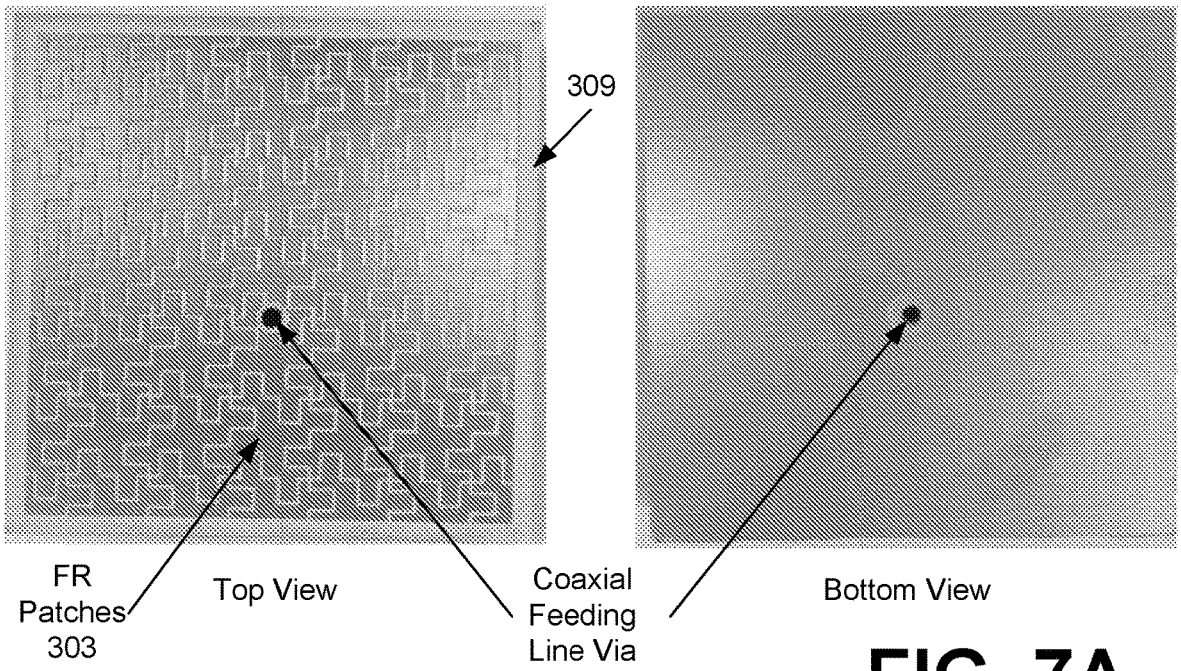
FIGS. 7A through 7D are images illustrating the fabrication of the GPS antenna of FIG. 5, in accordance with various embodiments of the present disclosure.
Figure 7B:
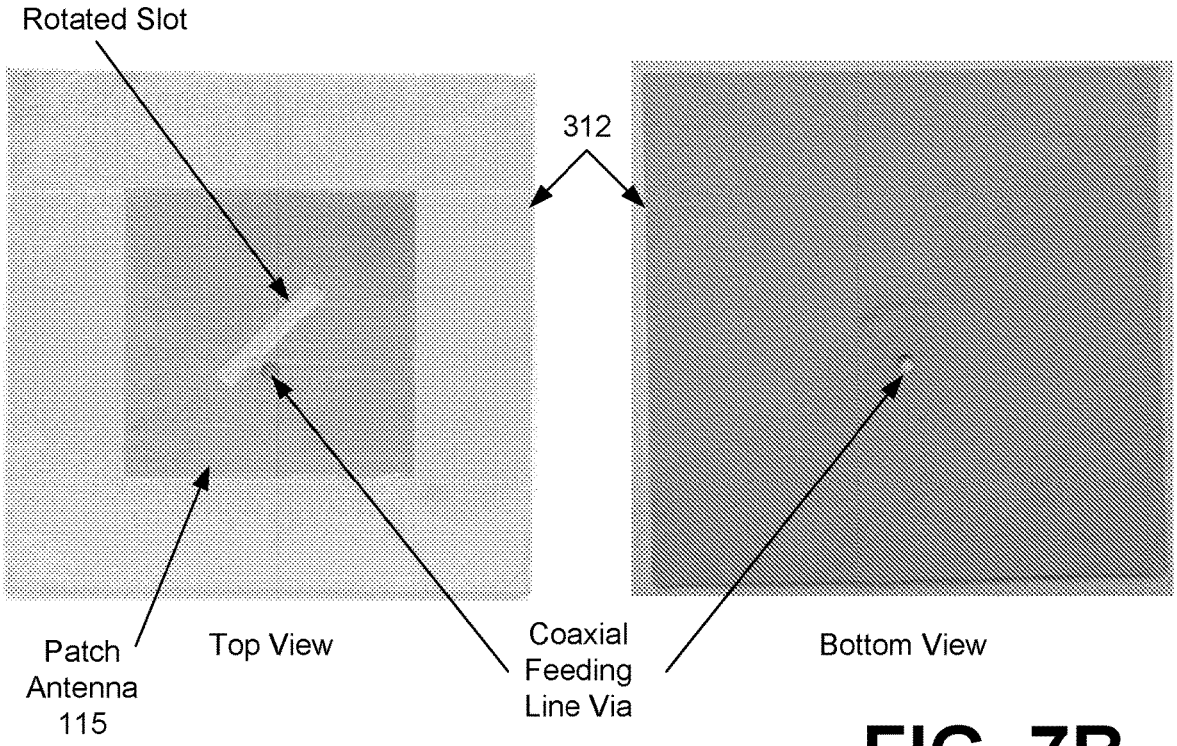

The GPS antenna design was implemented with a first substrate 309 of Rogers TMM® 10i with a thickness of 5.08 mm and a second substrate 312 of Rogers RT/Duroid® 6010LM with a thickness of 0.645 mm. The substrates 309/312 include vias (or openings) that allow the coaxial feeding line 315 to pass through. FR patches 303 were formed on one side of the first substrate 309 and a ground plane (or PEC) 306 was formed on the other side of the first substrate 309. FIG. 7A includes images of the FR patches 303 disposed on the top of the first substrate 309 and the ground plane 306 disposed on the bottom of the first substrate 309. The patch antenna 115 with the 45° rotated slot was formed on one side of the second substrate 312. FIG. 7B includes images of the antenna patch 115 disposed on the top of the second substrate 312 and the bare bottom of the second substrate 312.

Figure 7C:
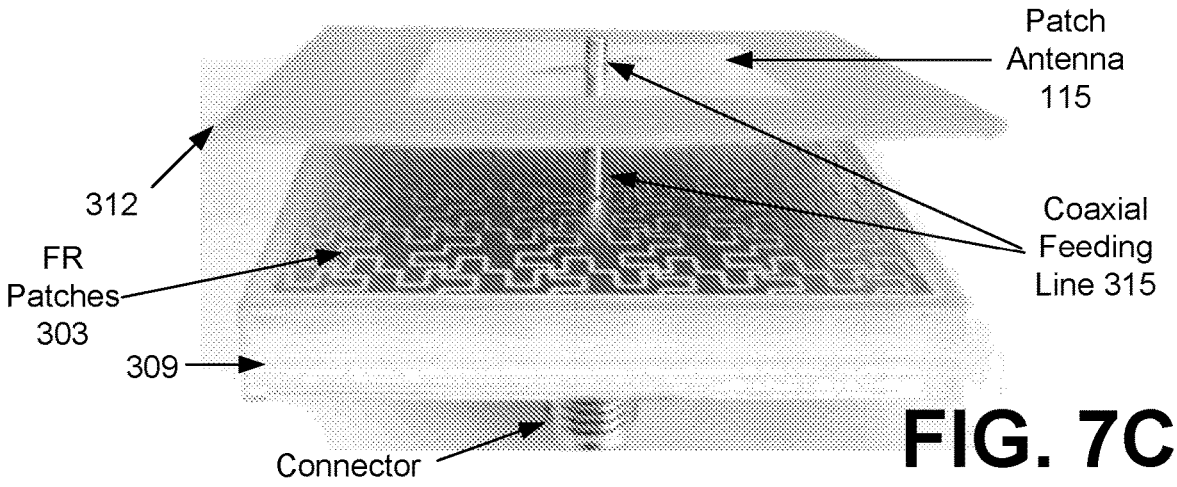
Figure 7D:
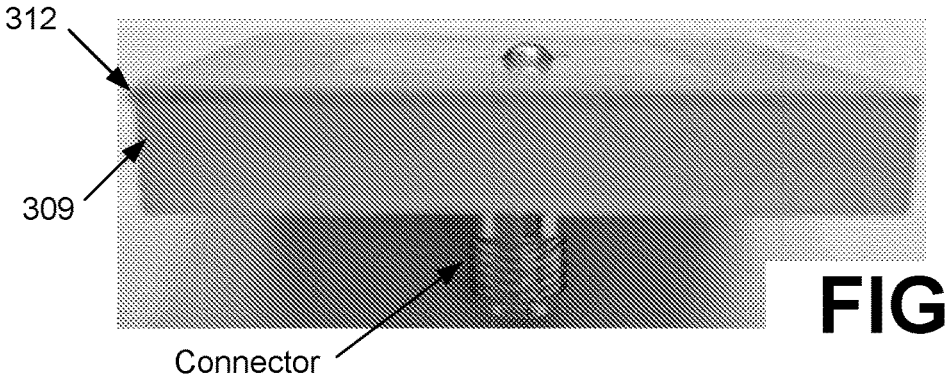
Figure 7E:
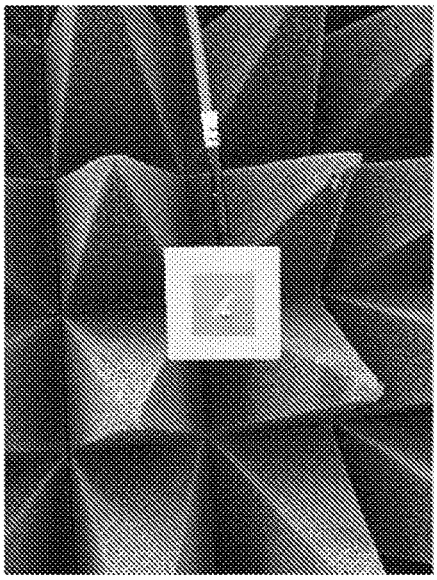
FIG. 7E includes images showing an antenna characterization setup.
Figure 7E:
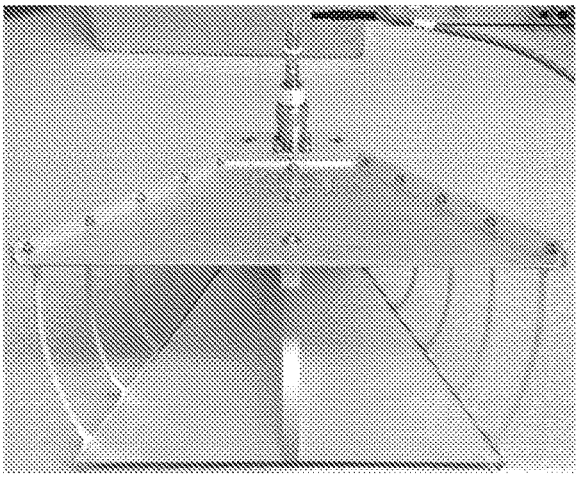

As illustrated in FIG. 7C, the second substrate 312 was placed on the first substrate 309 with the bare bottom of the second substrate 312 adjacent to the FR patches 312 on the top of the first substrate 309. The coaxial feeding line 315 passes through the vias or openings in the first and second substrates 309/312 for connection to the patch antenna 115. A SMA (subminiature version A) connector provides a detachable connection to the coaxial feeding line 315. The assembled GPS antenna is shown in FIG. 7D. The device under test (DUT) setup for testing of the fabricated GPS antenna, and the horn antenna used in the measurement setup, are pictured in FIG. 7E.

Figure 8A:
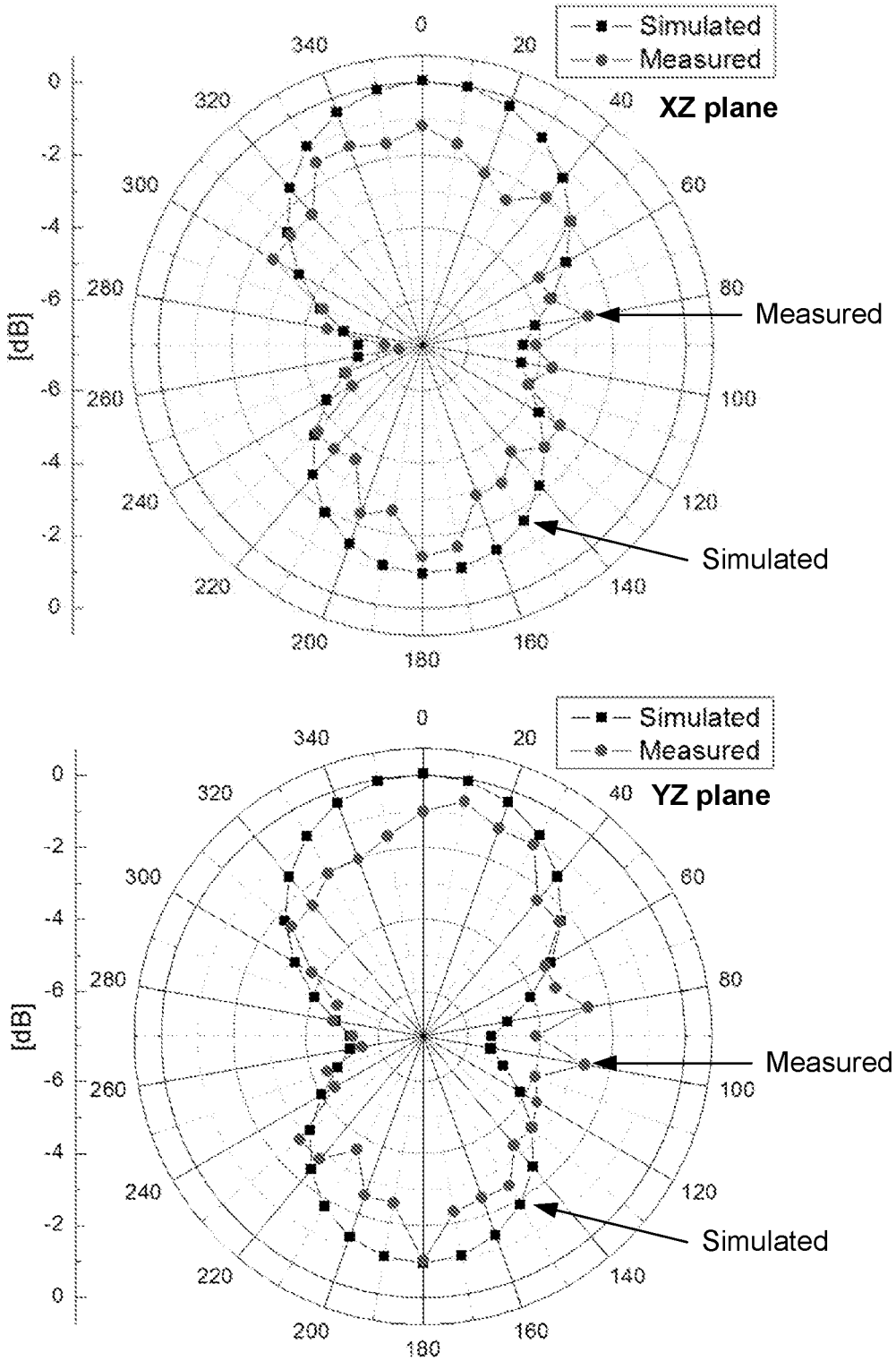
Figure 8B:
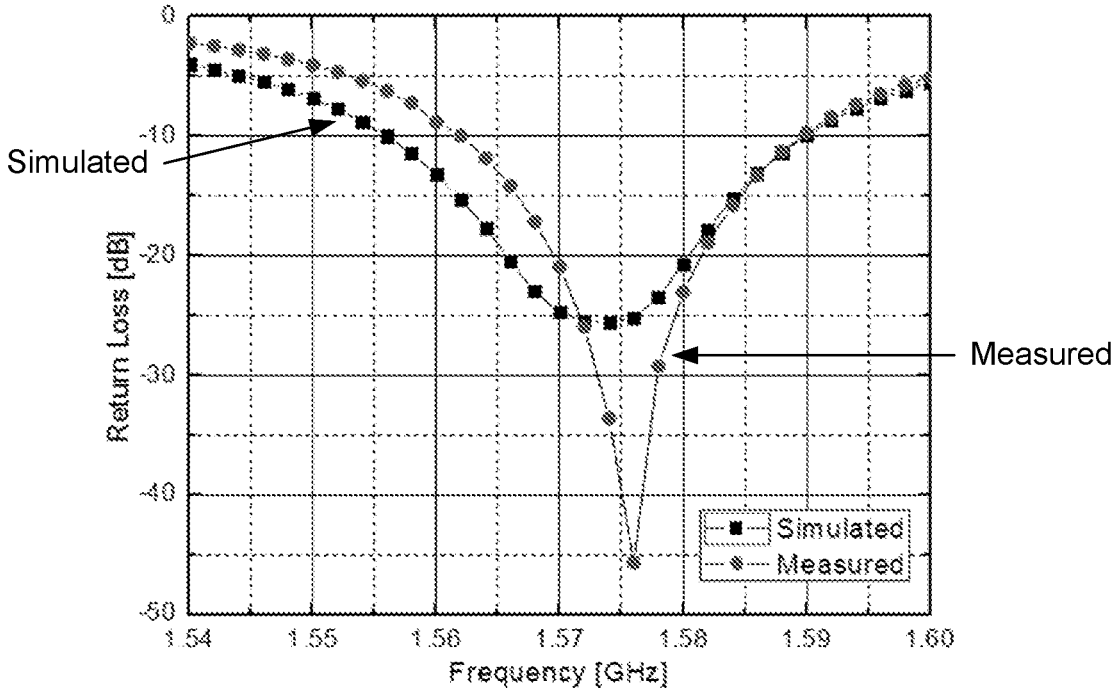
Figure 8C:
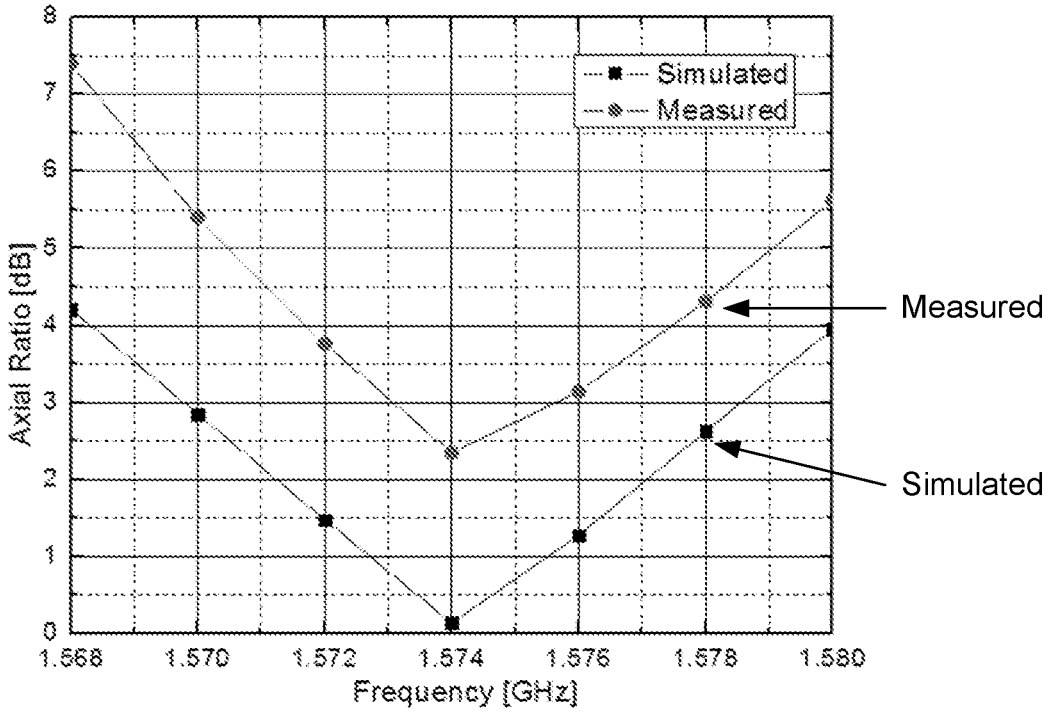

Referring now to FIGS. 8A-8D, shown are the measurement results of the fabricated GPS antenna of FIGS. 5 and 7A-7D. FIG. 8A compares the simulated and measured radiation patterns (total gain) in the XZ-plane (top) and YZ-plane (bottom). The total gain of the radiation patterns includes both right-hand circular polarization (RHCP) gain (or co-polarization gain) and left-hand circular polarization (LHCP) gain (or cross-polarization gain). FIG. 8B is a plot of the return loss and FIG. 8C is a plot of the axial ratio comparing the measured and simulated results for the GPS antenna design. The table in FIG. 8D summarizes the simulated and measured results, which are well matched.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

The term "substantially" is meant to permit deviations from the descriptive term that don't negatively impact the intended purpose. Descriptive terms are implicitly understood to be modified by the word substantially, even if the term is not explicitly modified by the word substantially.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include traditional rounding according to significant figures of numerical values. In addition, the phrase "about 'x' to 'y'" includes "about 'x' to about 'y'".

Therefore, at least the following is claimed:

1. An antenna, comprising:

a ground plane;

a fractal rectangular reactive impedance surface (FR-RIS) disposed over and separate from the ground plane, wherein the FR-RIS comprises a plurality of fractal rectangular (FR) patches including a plurality of inner FR patches surrounded by a plurality of outer FR patches, wherein the plurality of outer FR patches are distributed along an outer edge of the FR-RIS, wherein each of the plurality of inner FR patches comprises an outer edge defined by a fractal rectangular pattern that is repeated along each side of the inner FR patch and each of the plurality of the outer FR patches comprises an outer edge defined by the fractal rectangular pattern repeated along at least two sides of the outer FR patch and not repeated along at least one side of the outer FR patch, the at least one side of the outer FR patch defining a portion of the outer edge of the FR-RIS, wherein the fractal rectangular pattern along one side of one of the plurality of FR patches matches with the fractal rectangular pattern along an adjacent side of an adjacent FR patch of the plurality of FR patches with the fractal rectangular patterns of the adjacent sides interdigitated; and a planar antenna disposed over and separate from the FR-RIS.

2. The antenna of claim 1, wherein the fractal rectangular pattern comprises a rectangular tab extending outward from each side of each of the plurality of inner FR patches and a corresponding rectangular recess extending inward from each side of each of the plurality of inner FR patches.

3. The antenna of claim 1, wherein the FR-RIS comprises a gap between the fractal rectangular patterns on the adjacent sides of the adjacent FR patches of the plurality of FR patches, wherein a gap distance between the adjacent FR patches is substantially constant.

4. The antenna of claim 3, wherein a capacitance of the FR-RIS is based at least in part upon a length of the outer edge of each of the plurality of FR patches.

5. The antenna of claim 1, wherein the FR-RIS comprises a substrate disposed between the planar antenna and the plurality of FR patches.

6. The antenna of claim 5, wherein the planar antenna is coupled to a feeding line that passes through the plurality of FR patches and the substrate, wherein the feeding line is not coupled to the plurality of FR patches or the ground plane.

7. The antenna of claim 6, wherein the feeding line is a coaxial feeding line.

8. The antenna of claim 1, wherein the plurality of FR patches are disposed on a first side of a substrate, and the ground plane is disposed on a second side of the substrate opposite the plurality of FR patches.

9. The antenna of claim 8, wherein an inductance of the FR-RIS is based at least in part upon a distance between the ground plane and the plurality of FR patches.

10. The antenna of claim 9, wherein the inductance of the FR-RIS is further based upon a shape of the FR patches.

11. The antenna of claim 1, wherein the planar antenna is a patch antenna.

12. The antenna of claim 11, wherein the patch antenna comprises a slot.

13. The antenna of claim 12, wherein the slot is rotated with respect to the patch antenna.

14. The antenna of claim 13, wherein the slot is rotated at an angle of 45 degrees with respect to the outer edges of the plurality of FR patches.

15. The antenna of claim 1, wherein the outer edge of the FR-RIS defines a rectangular shape.

16. The antenna of claim 15, wherein the rectangular shape is a square.

17. The antenna of claim 15, wherein each of the plurality of outer FR patches are trimmed along the at least one side defining the portion of the outer edge of the FR-RIS to provide the rectangular shape.

18. The antenna of claim 15, wherein the patch antenna disposed over the FR-RIS has a rectangular shape, wherein an outer edge of the patch antenna is substantially parallel with the outer edge of the FR-RIS.

19. The antenna of claim 18, wherein the patch antenna is smaller than the FR-RIS.

* * * * *